United States Patent [19]

Kleer et al.

[11] Patent Number: 4,934,874

[45] Date of Patent: Jun. 19, 1990

[54] MOBILE PUMPING INSTALLATION

[75] Inventors: Johannes Kleer, Dudweiler, Fed. Rep. of Germany; Klaas T. Hove, Sleeuwijk, Netherlands; Wilhelm Beyer, Völkingen, Fed. Rep. of Germany

[73] Assignee: Saarbergwerke AG, Saarbrucken, Fed. Rep. of Germany

[21] Appl. No.: 272,988

[22] PCT Filed: Feb. 17, 1988

[86] PCT No.: PCT/DE88/00077

§ 371 Date: Dec. 21, 1988

§ 102(e) Date: Dec. 21, 1988

[87] PCT Pub. No.: WO88/06211

PCT Pub. Date: Aug. 25, 1988

[30] Foreign Application Priority Data

Feb. 21, 1987 [DE] Fed. Rep. of Germany ..... 3705598

[51] Int. Cl.[5] ..... E02F 3/88

[52] U.S. Cl. ..... 405/303; 37/58; 405/258

[58] Field of Search ..... 405/146, 303; 299/18; 37/58, 57, 64, 71

[56] References Cited

U.S. PATENT DOCUMENTS

| | | | |
|---|---|---|---|
| 2,952,083 | 9/1960 | Forkner | 37/58 X |
| 3,122,398 | 2/1964 | Tucker | 37/58 X |
| 3,362,752 | 1/1968 | Densmore | 299/18 |
| 3,393,942 | 9/1968 | Hanaya | 37/58 X |
| 4,024,655 | 5/1977 | Schweitzer | 37/58 |
| 4,255,882 | 3/1981 | Verboom | 37/58 X |
| 4,785,560 | 11/1988 | Hanson | 37/96 |

*Primary Examiner*—Dennis L. Taylor

*Attorney, Agent, or Firm*—Herbert Dubno; Ronald Lianides

[57] ABSTRACT

A mobile transfer device is provided with a high-pressure piston pump connected to a conveyor pipeline having a portion upstream of the pump forming a suction pipe, an elongated loading shovel being provided at a forward end of the transfer device disposed transverse thereto, with means connected between the transfer device and the shovel for raising and lowering the shovel, an elongated screw conveyor being disposed in the shovel longitudinally thereof at a rear wall of the shovel, the screw conveyor having a conveying end point at an inlet of the suction pipe which opens into the shovel, and an elongated stamping mill provided in the shovel above the screw conveyor and parallel thereto and being provided with a plurality of swingable stampers distributed therealong and adapted to engage sludge in said screw conveyor for treatment thereof.

14 Claims, 3 Drawing Sheets

MOBILE PUMPING INSTALLATION

The present invention relates to an apparatus for transporting sludge, particularly in the clearing of sludge galleries in underground mining, i.e. for the collection of sludge from the floor and the intermediate underground transportation thereof, with a mobile transfer device having a clearing shovel and a pump connected to a conveyor pipeline.

BACKGROUND OF THE INVENTION

The waste waters forming in mining galleries, the so-called pit water, is collected in sludge. Such sludge galleries are provided in the area or underneath the deepest mining floor and serve solely for the collection of the pit water, which is evacuated from there to the surface with the aid of pumps. In a sludge gallery, the heavy particles collect, i.e. the sludge settles at the bottom, so that after such a sludge gallery is pumped empty of the pit water, the resulting sludge is aspirated from the floor and then as a rule transported via conveyor trucks to the surface.

From the Trade Journal of the Ruhrkohle Aktiengesellschaft 2/85 (BAG Niederrhein), an apparatus is known which sweeps together the sludge under water and then aspirates it through pumps. A clearing shield is provided on a movable bridge and swingably supported thereon, with an eccentric worm pump hanging in front of the clearing shield which aspirates the collected sludge, and after further treatment, for instance dewatering through centrifugal action, the sludge is transferred to large conveyor trucks, which carry the material to the surface. In this known system, a first disadvantage is that the permanently is stationarily located in such a sludge gallery, and as a result is not available for other operations, e.g. for another sludge gallery. Another disadvantage is also the considerable deployment of machines, whereby due to the relatively watery material, the intervention of a solid-jacket worm centrifuge is required. Only after the treatment in this centrifuge does it becomes possible to evacuate the material in open 3000 l trucks.

OBJECT OF THE INVENTION

It is the object of the invention to create a mobile apparatus for the collection and transportation of sludge, capable of handling sludge with a high content of solid material.

SUMMARY OF THE INVENTION

The object is attained according to the invention in that the transfer device is a mobile unit having a loading shovel which can be raised and lowered, at whose rear wall a transversely positioned screw conveyor is provided inside the shovel, the conveying point of this conveyor coinciding with the opening of a suction pipe of a pump, which is built as a high-pressure piston pump and that above the screw conveyor a stamping mill is provided to act upon the sludge in the screw with stampers being provided for this purpose.

Such a pumping apparatus is widely usable, since it represents a mobile unit, and can be used in the established sludge gallery, as well as in other sludge galleries, and also in other areas. The raisable and lowerable loading shovel makes it possible to safely collect the sludge and to direct it in a controlled manner via the screw conveyor located at the rear wall towards the high-pressure piston pump having control valves, through which the sludge is then directly loaded into trucks through the conveyor pipeline. Due to the stamping mill, it is insured that each time an optimal mixture of the solids and the remaining residual water in the solids is achieved, so that the formation of bridges is prevented. In this way, a sludge with a high content of solids reaches the high-pressure piston pump, and subsequently the trucks. Based on this concentration of solids in the sludge, it is even possible to further move the thick sludge over belt conveyors, in an operationally safe manner. The screw conveyor also makes sure that the high-pressure piston pump is steadily supplied with sludge, so that a uniform uninterrupted volume of the stream, and thereby a uniform loading of the pump, is insured. The controlled valves of the high-pressure piston pump insure a high efficiency and a uniform operation. In comparison with the described state-of-the-art systems, this apparatus has the further advantage of a general compact overall size, which can also be used in sludge galleries of various dimensions. Furthermore, such an apparatus can also be used in the surface transport of sewer sludge. A thinning of the sludge through the addition of water is, as a rule, not required in this case, since the material supplied controllably to the pump can be evacuated safely.

Efficient handling of the apparatus is insured due to the fact that the loading shovel is pivotally mounted at the free end of a supporting arm, which in turn is swingably supported on the transfer device. In this way, the loading shovel can each time be set in a position wherein it can safely collect the sludge lying on the floor of the gallery, independently of the thickness of the layer. The loading shovel is applied each time efficiently to the gallery floor, and in this way slides securely into, and under the sludge layer.

The collecting of the sludge is performed especially evenly and securely, because according to the invention, the loading shovel is held via a linkage harness formed by the supporting arm and the supporting cables, whereby the support cables are connected in such a manner as to impact a variable inclination to the loading shovel with the aid of tension locks. When the supporting arm with the loading shovel is lowered, the point of the loading shovel automatically hits the gallery floor, and through the advancement of the transfer device, the sludge layer is pressed onto the shovel. Since the loading shovel is swingably suspended via the support cables, it can advantageously avoid an obstacle and operate on uneven ground. In this way, the loading shovel is optimally held by the linkage harness so that the sludge can be safely collected and pushed through to the screw conveyor, where it is taken over by the latter and further transported.

The linkage harness forms a quadrangular linkage since the support cables run above the supporting arm and are linked correspondingly above its pivot points to the transfer device and the loading shovel. In this way, the loading shovel and the separation between the pivot points on the transfer device, form the quandrangular linkage together with the supporting arm and support cable. Such a quadrangular linkage is stable and precisely adjustable, so that in general a very advantageous device is created.

According to a further development of the invention, the support cables are connected to the transfer device by stable mounting plates which can safely absorb "shocks" occuring during swing and rocking.

A screw conveyor with high conveying efficiency is created as a result of the fact that the rear wall of the loading shovel and the loading surface are designed so as to form a tube enveloping the screw conveyor, whereby the tube is provided with a wide longitudinal slot facing towards the open side of the loading shovel. Through the longitudinal slot, the sludge is pushed into the tube to the screw conveyor, where it is entrained by the latter and further transported, while the individual stampers of the stamping mill the optimal blending of water and solid materials with a high degree of fullness for the screw conveyor.

In the area of the suction opening, the longitudinal slot is interrupted, i.e. the tube is closed at this point, in order not to impair the suction efficiency of the pumps. For the same reason, the screw conveyor has no spiral in this area which forms the conveying end point.

The particular configuration of the envelope of the screw conveyor is made possible first by the design of the rear wall and further by the fact that on the loading surface before the screw conveyor a wedge-like attachment is mounted, whose rear wall is curved correspondingly to the screw conveyor.

Advantageously short transport paths are achieved because the suction pipe with its opening is arranged in the center of the loading shovel and that the screw conveyor is provided with spirals operating in the opposite direction on each half side toward the center. The screw conveyor is thereby driven by a drive arranged to one side. Due to the movement in the screw conveyor, the sludge is advantageously mixed and fluidized, so that it can be transported further by the pumps.

In order to obtain preestablished high solid concentrations in an optimal blend of water and solids, as already mentioned before, stampers are provided which are distributed over the length of the screw conveyor. These fulfill their function due to the fact that they are semicircularly curved and mounted on a shaft which is formed as a crankshaft driven by piston rods, which shaft runs above the rear wall and that the stamper foot reaches through the longitudinal slot, coming very close to the screw conveyor. It can be advantageous under certain circumstances when the shaft is connected to the drive of the screw conveyor preferably over a second output.

In order to avoid a too high concentration of solids and the resulting conveying disturbances, the invention proposes that an additional nozzle system be provided for the screw conveyor, preferably in the form of a pipe with openings and nozzles, which runs above the longitudinal slot. This way the possibility exists to thin the sludge in a controlled manner, so that it reaches the pump with an approximate concentration of 75%.

The mobility of the apparatus according to the invention is achieved especially when the transfer device is a caterpillar-type vehicle. Also, the apparatus is mobile to a similar extent and not location bound when the transfer device consists of transport trolleys, movable along an EHB-track, whereby in both cases the sludge receiving- and transport device is actually mounted on the transfer device. In the case of the caterpillar-type vehicle, the transfer device is freely movable on the floor of the gallery and thereby capable of being used at any other location, while in the case of the transport trolleys moving on EHB-tracks only, galleries where such tracks exist or can be mounted have to be considered. Thus, the apparatus is very versatile, and, as already mentioned, can be used not only in underground operations, but just as advantageously in surface operations.

The invention is particularly characterized in that an apparatus is provided which makes it possible to securely remove the sludge collected in sludge galleries, to direct it to a pump in a thoroughly blended state with a high concentration of solids and to transport it from this pump to a truck where it is further transported. It is of particular advantage that with such an apparatus a sludge gallery can be cleared and cleansed without further treatment in the shortest time. The sludge material has a solid content up to 75%, so that the sludge can even be transported on belt conveyors.

BRIEF DESCRIPTION OF THE DRAWING

Further details, advantages and objects of the invention will become more apparent from the following description, references being made to the drawing, in which.

SPECIFIC DESCRIPTION

Figure 1:
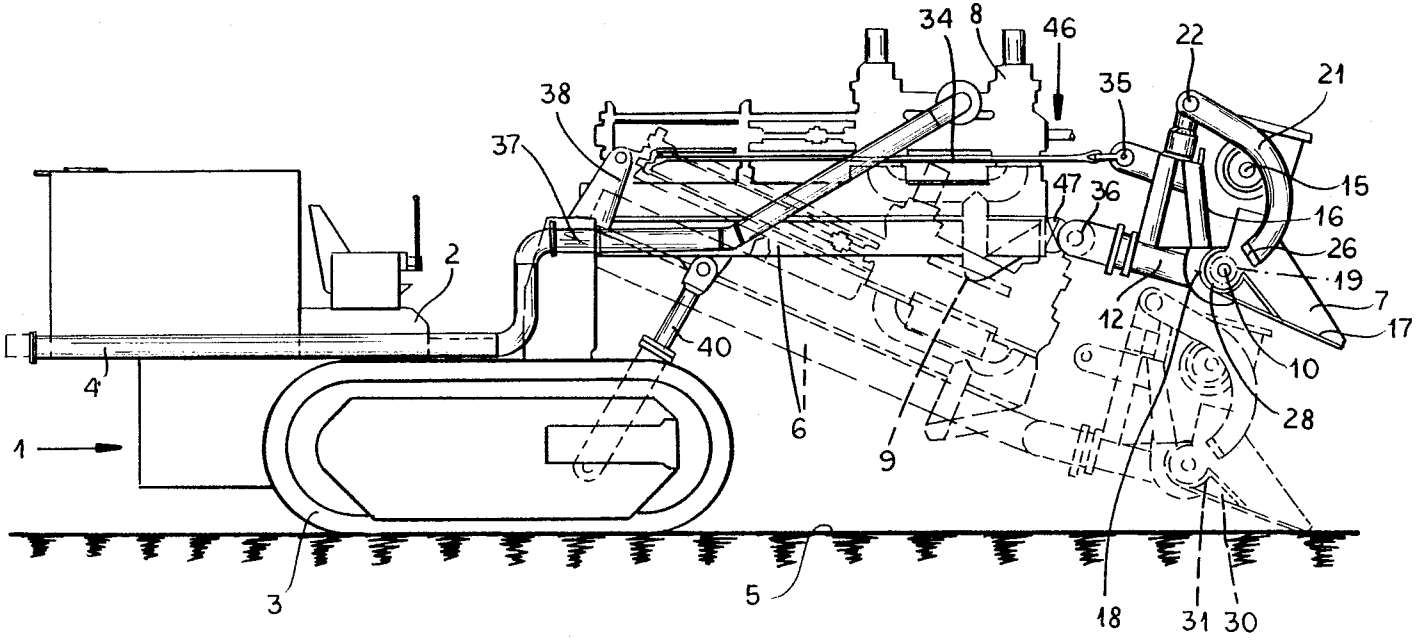
FIG. 1 is a side elevational view of the pumping apparatus.
Figure 2:
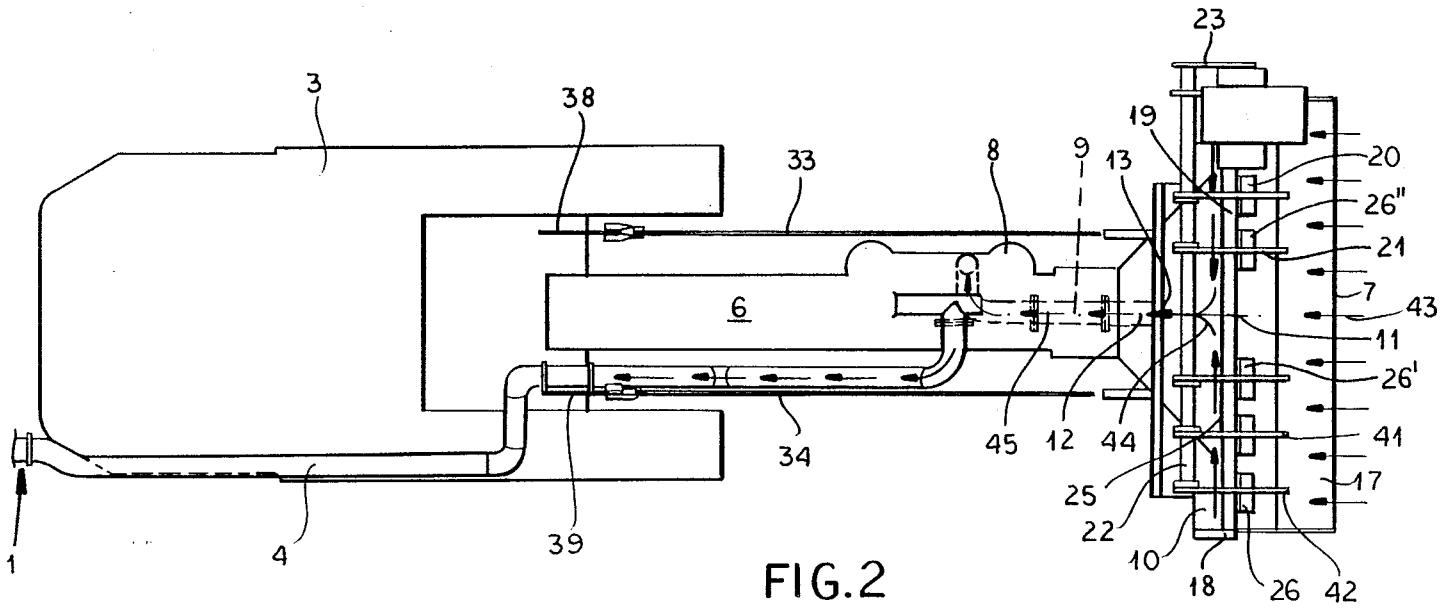
FIG. 2 is a top plan view thereof.

The pumping installation 1 represented in FIGS. 1 and 2 consists of the transfer device 2, in this case a crawler 3 which is connected to a conveyor line 4 and can be moved along the gallery floor 5.

Behind the transfer device 2, the conveyor line 4 is lead upwardly for instance to a conveyor line rigidly fastened to the gallery roof and is there connected via a connection member. The conveyor line 4 itself is, for instance, a flexible hose.

A loading shovel (7) is connected to the crawler 3 forming the transfer device 2 through a supporting arm 6, the supporting arm 6 carrying a pump 8, through which the material collected in the loading shovel 7 is aspirated through the suction pipe 9 and then compressed into the conveyor pipe 4. This material is a sludge with solid particles of various sizes. The suction pipe 9 ends in the area of the screw conveyor 10, which is located in the loading shovel 7, extending along in its longitudinal axis. At a conveying end point 11, a suction pipe 12 with its opening 13 is arranged and forms an extension of pipe 9, so that the material coming from the screw conveyor 10 reaches the pump 8 built as a high-pressure piston pump, as an advantageously intermixed and blended mass, and this homogenuous mixture making it possible to achieve a uniform and highly efficient sludge conveying operation.

The screw conveyor 10 is set in rotation by the drive 15, whereby the screw conveyor rotates in a tube 18 formed by the rear wall 16 and the loading surface 17 of the loading shovel 7. This tube 18 has a longitudinal slot 19, through which the sludge enters the tube 18 and from there is moved forward by the screw conveyor 10 toward the conveying point 11, where it is drawn in by the suction pipe 12.

A stamping mill 20 having several stampers 21 distributed over the length of the loading shovel 7, operates along the longitudinal slot 19. These stampers 21 are rotatably connected to a shaft 22 having a crank 22' driven by piston rods 22'', which run along the top side of the rear wall 16. By a second driven shaft 23 the shaft 22 can be connected to the drive 15 in such a manner that the stampers 21 are each successively raised and lowered. In the case of a high concentration of solids, an optimal mixing of the water with the solids is obtained this way. At the same time, over the length of the screw conveyor 10, bridging is effectively prevented, the individual stampers 21 each having a widened foot 26 for this purpose, as can be clearly seen, especially in FIG. 2. This stamper foot 26, together with the stamper foot of the next stamper, forms a partial covering of the longitudinal slot 19 in the tube 18, respectively the enveloping tube of the screw conveyor 10.

For the case when a regulation of the concentration of solids is required, a nozzle system 25 can be provided, consisting of a water pipe running above the longitudinal slot 19 having holes with nozzles, not represented in the drawing.

Figure 3:
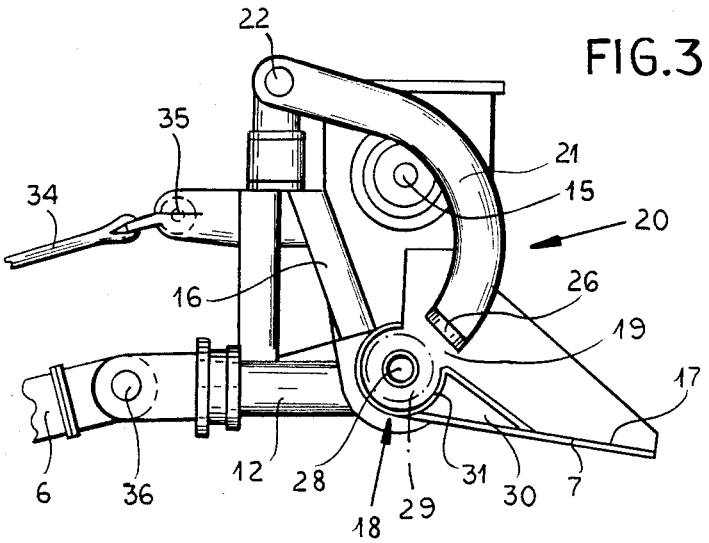
FIG. 3 is a side elevational view of a loading showel, drawn to a larger scale.
Figure 4:
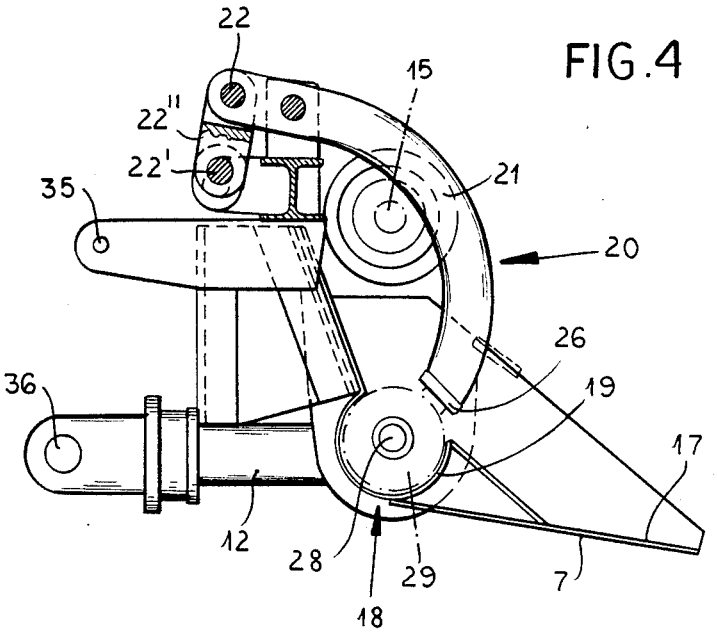
FIG. 4 shows the arrangement of the stampers.

FIG. 3 shows clearly that due to the rear wall (16) bent like a pipe and to the curved configuration of the rear wall 31 of a wedge-like attachment 30, located on the loading surface 17, an advantageous enveloping tube 18 for the screw conveyor 10 is created. The wedge-like attachment 30 can optionally be slightly adjusted on the loading surface 17, so that the volume of the sludge to be transported by the screw conveyor 10 can be modified, depending on its concentration of solids. However, it is simpler to adjust the rotational speed of the screw conveyor.

The inclination of the loading shovel 7 can be modified in a simple and suitable way via the support cables 33, 34 by the tension locks provided thereon. These support cables run basically parallel to the support arm and are also linked through articulations to the transfer device 2 and the loading shovel 7. Together on, they form a square hinge assembly with the loading shovel, on and the transfer device, which assembly affords a very stable support for the loading shovel 7.

The anchor points 35 of the support cables 33, 34 are located above the pivot points 36 and 37 of the support arm 6 and at a distance therefrom, whereby on the crawler 3 stable mounting plates 38, 39 are provided, to which the ends 36 and 37 of the support cables 33 and 34 are attached. By actuating the tension locks, the inclination of the loading shovel 7 can be changed. Thus, FIG. 1 shows in broken lines the position assumed by the loading shovel 7 when it swings and touches the gallery floor 5.

The support arm 6 is pivoted and supported at the same time by the hydraulic cylinder 40, which is swingably linked to the crawler 3 as well as to the support arm 6.

With reference to FIG. 2, the path followed by the sludge taken up by the loading shovel 7 is indicated by arrows 43, 44, 45. Further, in FIG. 2, the arrangement of the various stampers 21, 41, 42 with their feet identically shaped for each kind of stamper, is represented. Here it becomes clear that the stamper feet 26, 26', 26'' can cover almost entirely, and influence, the longitudinal slot 19, so that bridging is safely prevented.

In the suction pipe 9 a shut off valve 47 is provided upstream of the pump 8 and at the pump 8 a fresh-water valve 46 is provided. In FIG. 1, these are correspondingly indicated. When the shutoff valve 47 is closed, the pump 8 and the subsequently connected transfer device can be flushed with fresh water and cleaned, prior to a break in the operation. It is also advantageous to fill the pump 8 with fresh water before a new start, in order to facilitate the restarting of the pump 8.

We claim:

1. A mobile pumping apparatus for clearing sludge from the galleries of underground mines, said apparatus comprising:

a mobile transfer device;

a high-pressure piston pump provided on said transfer device and connected to a conveyor pipeline, said pipeline having a portion upstream of said pump forming a suction pipe;

an elongated loading shovel provided at a forward end of said transfer device and disposed transverse thereto;

means connected between said transfer device and said shovel for raising and lowering said shovel;

an elongated screw conveyor disposed in said shovel longitudinally thereof at a rear wall of said shovel, said screw conveyor having a conveying end point at an inlet of said suction pipe which opens into said shovel; and an elongated stamping mill provided in said shovel above said screw conveyor and parallel thereto, said stamping mill being provided with a plurality of swingable stampers distributed therealong and adapted to engage sludge in said screw conveyor for treatment thereof.

2. The apparatus defined in claim 1 wherein said means for raising and lowering said shovel is a support arm pivotally mounted on said transfer device and having a free end on which said shovel is pivotally mounted.

3. The apparatus defined in claim 2, further comprising at least one support cable connected between said transfer device and said shovel and forming with said support arm a linkage harness, said cable being provided with a tension lock for adjusting the inclination of said shovel.

4. The apparatus defined in claim 3 wherein one end of said support cable is connected to said transfer device above the pivot mount of said arm thereon, and the other end of said cable is connected to said shovel above the pivot mount of said shovel on said arm, whereby said cable is disposed above said support arm.

5. The apparatus defined in claim 3, further comprising a stabilized mounting plate on said transfer device to which said support cable is connected.

6. The apparatus defined in claim 1 wherein said elongated loading shovel is provided with an elongated forward loading surface disposed in said shovel longitudinally thereof and forming with said rear wall an elongated trough partially enveloping said screw conveyor, whereby said trough is formed with a forwardly facing elongated opening through which said sludge can enter said screw conveyor.

7. The apparatus defined in claim 1 wherein said elongated loading shovel is provided with an elongated forward loading surface disposed in said shovel longitudinally thereof and provided with an elongated wedge-shaped attachment disposed forwardly of said screw conveyor and parallel thereto, said wedge-shaped attachment having an arcuate backside corresponding to said screw conveyor and forming with said rear wall an elongated trough partially enveloping said screw conveyor, whereby said trough is formed with a forwardly facing elongated opening through which said sludge can enter said screw conveyor.

8. The apparatus defined in claim 1 wherein said suction pipe inlet is disposed centrally in said loading shovel, whereby at either side of said conveying end point said screw conveyor is formed with oppositely running spirals.

9. The apparatus defined in claim 1 wherein each of said stampers is arcuate and formed with a respective foot adapted to extend into said elongated opening adjacent said screw conveyor, each respective stamper being connected to a crankshaft driven by a respective piston rod, said respective piston rods being disposed above said rear wall of said loading shovel.

10. The apparatus defined in claim 1 wherein each of said stampers is arcuate and formed with a respective foot adapted to extend into said elongated opening adjacent said screw conveyor, said stampers being connected to a driveshaft.

11. The apparatus defined in claim 1, further comprising a nozzle system disposed above said screw conveyor, said nozzle system being formed by an elongated pipe extending parallel to said screw conveyor and provided with a plurality openings forming nozzles.

12. The apparatus defined in claim 1 wherein said mobile transfer device is a tracked vehicle.

13. The apparatus defined in claim 1 wherein said mobile transfer device is a transport trolley displaceable along a set of tracks.

14. The apparatus defined in claim 1, further comprising a fresh-water valve connected between said piston pump and a water supply, and a shutoff valve provided in said suction pipe, said fresh-water valve being operable when said shutoff valve is closed for flushing fresh water through said pump.

* * * * *